United States Patent [19]

Marvin et al.

[11] Patent Number: 4,856,662

[45] Date of Patent: Aug. 15, 1989

[54] PEDESTAL CRANE AND METHOD OF ASSEMBLING AND ERECTING IT

[75] Inventors: Jack C. Marvin; Benjamin G. Shepherd, both of Spring, Tex.

[73] Assignee: CBI Research Corporation, Oak Brook, Ill.

[21] Appl. No.: 130,424

[22] Filed: Dec. 9, 1987

[51] Int. Cl.[4] ..... B66C 23/32

[52] U.S. Cl. ..... 212/176; 212/175; 212/177

[58] Field of Search ..... 212/175, 176, 177, 179, 212/180, 223, 225, 230, 267, 268, 185

[56] References Cited

U.S. PATENT DOCUMENTS

| | | | |
|---|---|---|---|
| 3,934,729 | 1/1976 | Wellman | 212/185 |

FOREIGN PATENT DOCUMENTS

| | | | |
|---|---|---|---|
| 132892 | 2/1985 | European Pat. Off. | 212/267 |
| 2029016 | 6/1970 | Fed. Rep. of Germany | 212/225 |
| 3337911 | 5/1985 | Fed. Rep. of Germany | 212/175 |
| 1159927 | 7/1958 | France | 212/176 |
| 1255562 | 12/1961 | France | 212/176 |
| 966740 | 8/1964 | United Kingdom | 212/176 |

*Primary Examiner*—Sherman D. Basinger

*Assistant Examiner*—Thomas J. Brahan

*Attorney, Agent, or Firm*—Marshall, O'Toole, Gerstein, Murray & Bicknell

[57] ABSTRACT

A method of installing a boom on the top of a high vertical tower comprising vertically positioning a first tower section and securing the tower section to a base; installing a plurality of additional tower sections in consecutive order on top of the first tower section and securing the adjoining sections together until a tower is erected having a desired height; a boom having a base section, at least one extendable section and a load lifting end; releasably attaching the boom in vertical position to and along side the tower as it is erected with the boom load lifting end at the bottom; jumping the boom vertically upwardly by alternately extending and retracting various boom sections as the tower sections are installed; positioning the boom base end adjacent the boom turret, tilting the boom turret into close contact with the boom base end and joining the turret to the boom base end by a horizontal boom footpin; releasing the boom lifting end from the tower; tilting the turret into contact with the adapter upper portion top end and releasably securing the turret to the adapter; and attaching apparatus to the boom for pivoting the boom vertically about the horizontal boom footpin.

12 Claims, 12 Drawing Sheets

FIG. 10
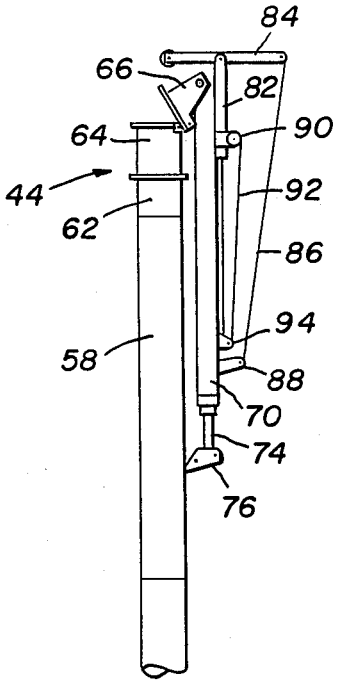
FIG. 11
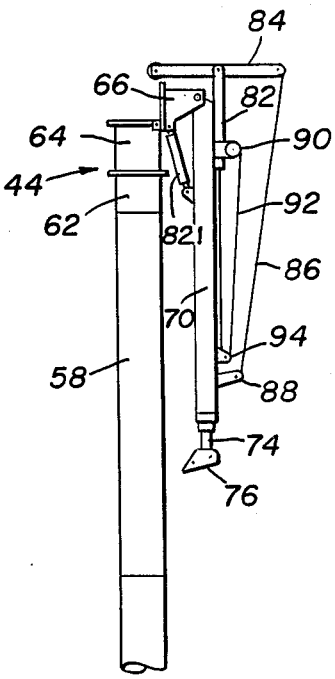
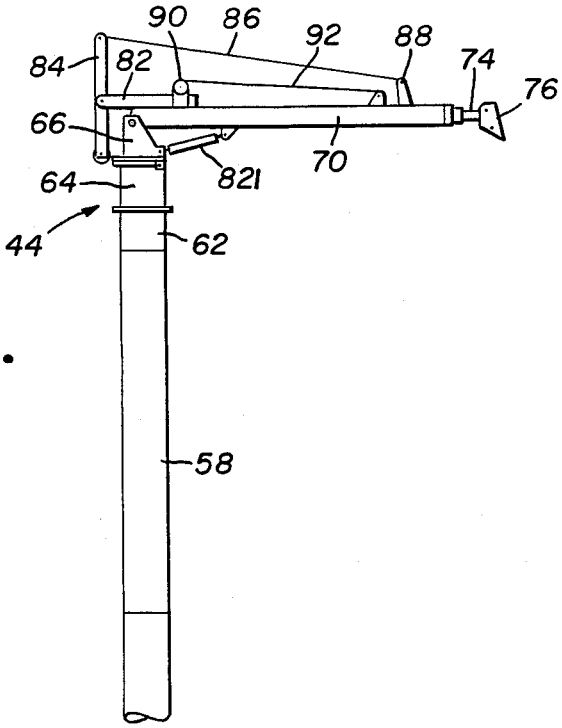
FIG. 12
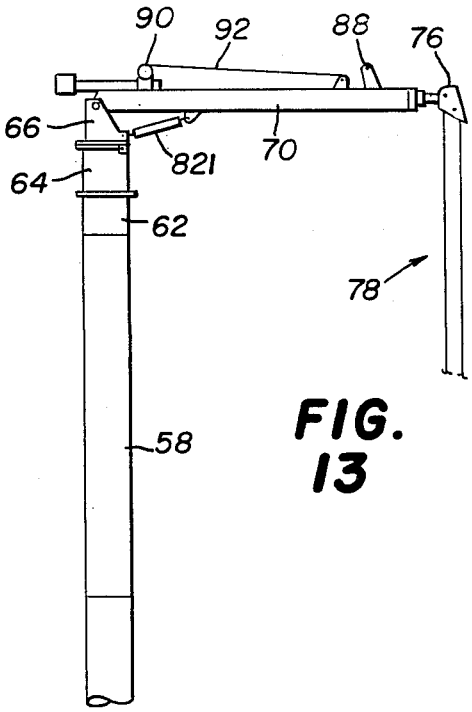
FIG. 13

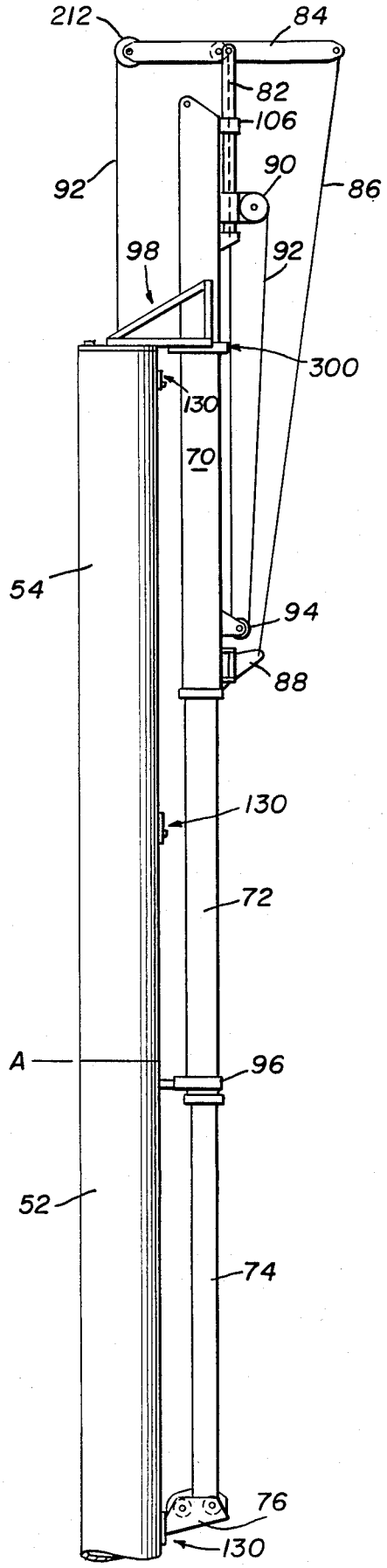
FIG. 26
FIG. 14
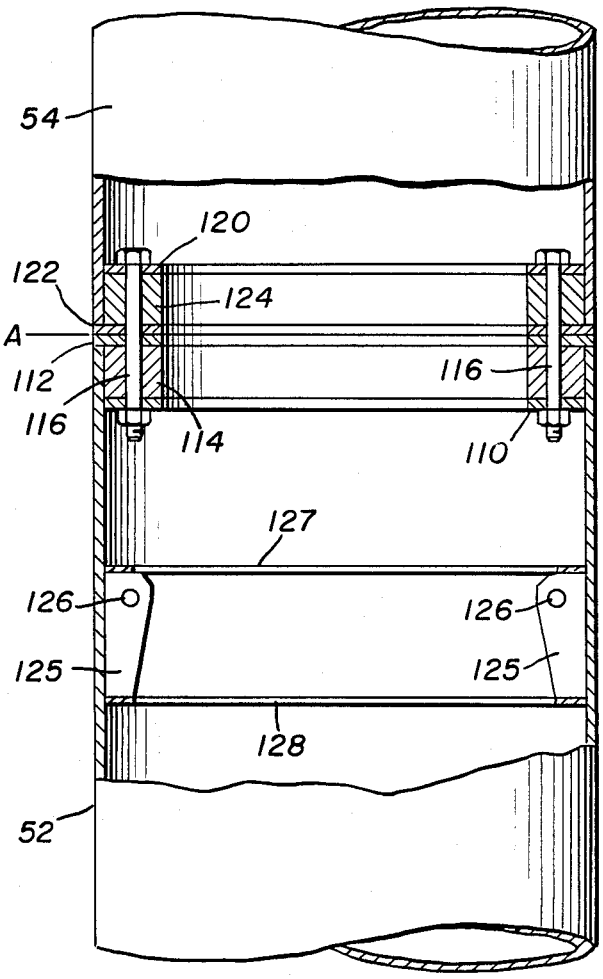

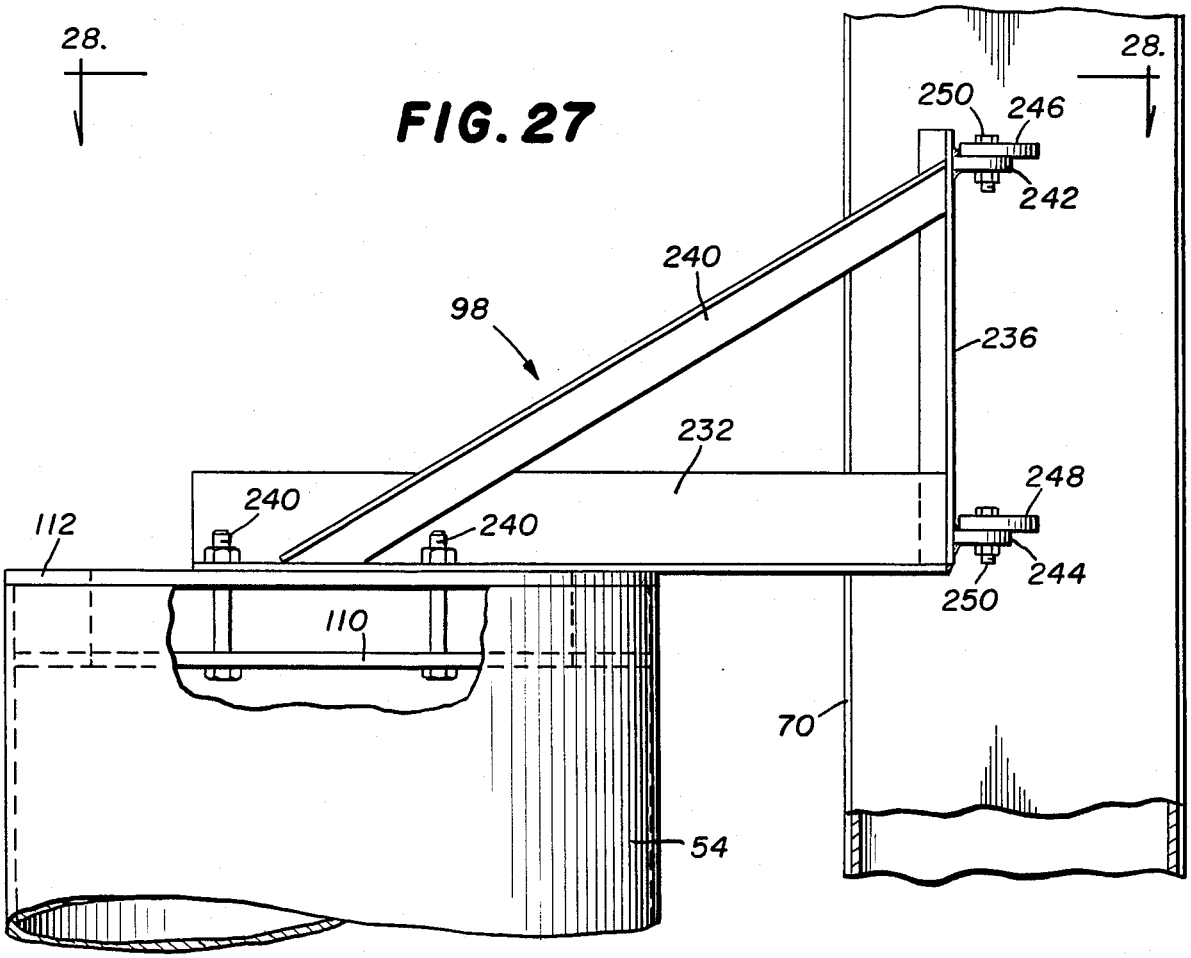
FIG. 27
FIG. 28
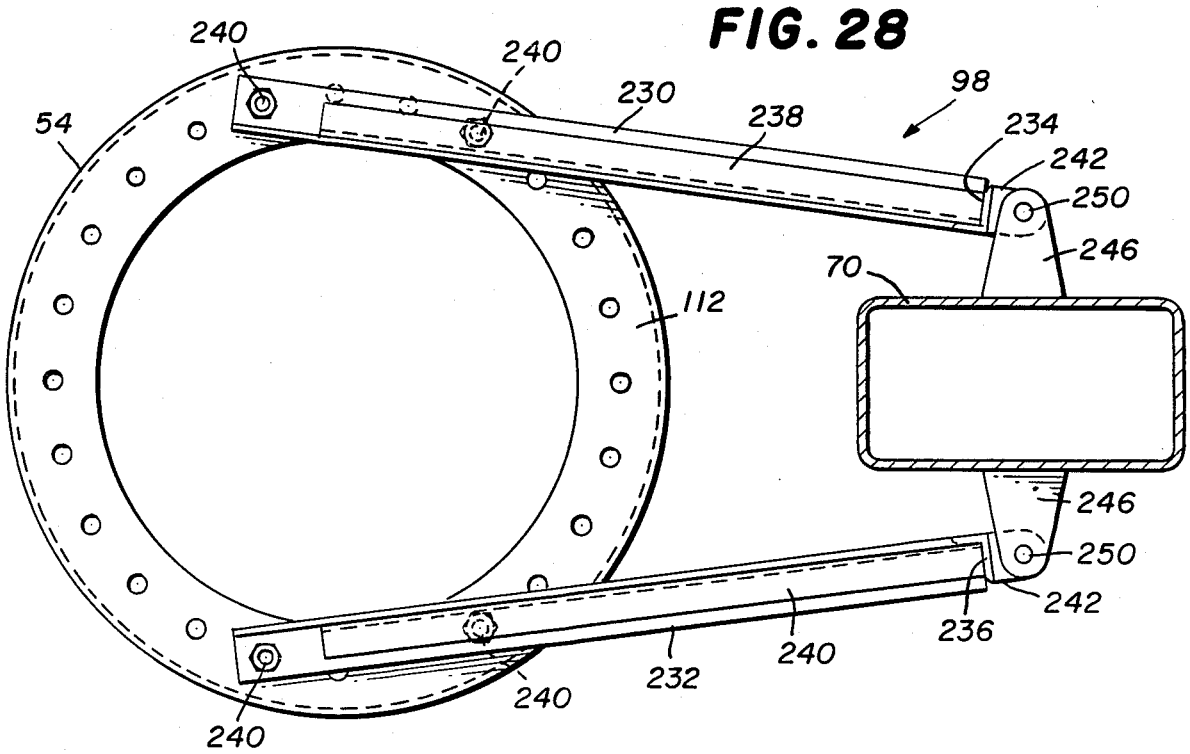

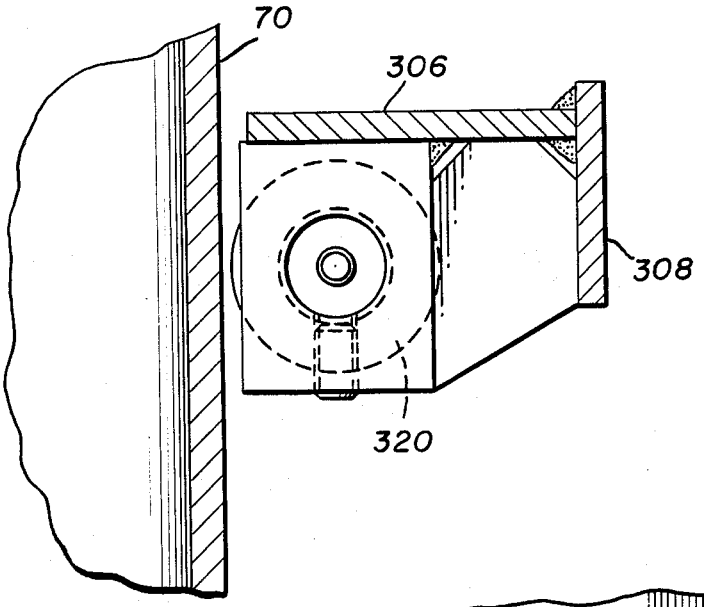
FIG. 33
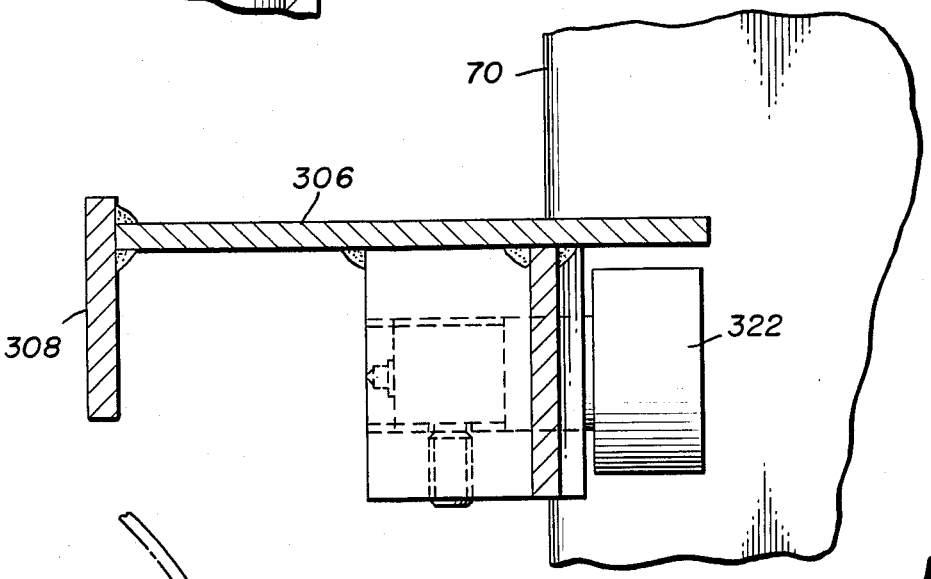
FIG. 34
FIG. 15A
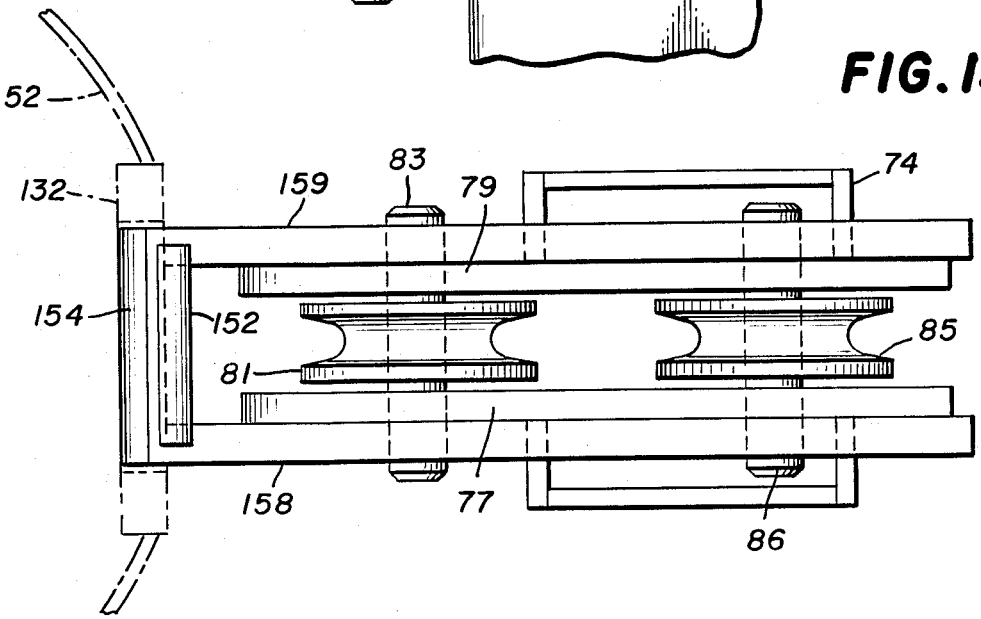

PEDESTAL CRANE AND METHOD OF ASSEMBLING AND ERECTING IT

This invention relates to cranes, derricks, booms and related load lifting equipment used in the construction, fabrication and manufacturing industries. More particularly, this invention concerns a vertical tower mounted pedestal crane, method of erecting the tower by adding sections by jumping a boom vertically upwardly along the tower side and then operatively positioning the boom on a pedestal on the tower top to complete the crane.

BACKGROUND OF THE INVENTION

The construction and installation of various structures such as buildings, bridges and towers requires the use of load lifting equipment suitable for the project location and intended purpose. Economic considerations dictate that the equipment used involve minimum capital investment, be transportable and, if necessary, assembled and erected in a reasonable amount of time. These limitations present rather acute problems when high structures such as elevated water tanks, highway overpasses and bridge support columns are erected. Erecting load lifting equipment for constructing high structures desirably requires a minimum of ancillary mechanical equipment so as to reduce labor and related costs. To do this, however, necessitates that the final load lifting equipment have self-contained features which permit it to at least partially lift and erect itself and, after the job is done, be demountable and disassembled largely by means of its own elements and components.

Hines U.S. Pat. Nos. 2,720,694; 2,754,012 and 2,768,432 disclose apparatus and methods of erecting elevated structures, and especially elevated water tanks. The apparatus and methods disclosed in these patents have been used industrially, in slightly modified variations, for about thirty to forty years. There are at least several important disadvantages to use of the prior art system. These include a need to have a second or auxiliary crane on the project, a bolting ring on the derrick, undesirably high freight costs and rigging labor costs and a complicated erection sequence and a lack of flexibility for use on a wide variety of jobs. There is thus a need for alternative apparatus for erecting high structures.

SUMMARY OF THE INVENTION

According to one aspect of the invention, there is provided a pedestal crane comprising a high vertical tower; an adapter having an upper portion rotatably mounted on bearing means supported by a lower portion with means releasably securing the adapter lower portion to the tower top; a boom turret pivotally joined to the top of the adapter upper portion to rotate about a horizontal axis; a boom having a base section, at least one extendable section and a load lifting end; means joining the boom base end to the turret by a horizontal boom footpin; means for tilting the turret into contact with the adapter upper portion top end and means releasably securing the turret to the adapter; and means for pivoting the boom vertically about the horizontal boom footpin.

The means for lifting the boom vertically about the horizontal boom footpin can comprise a hydraulic cylinder means and it can be operatively connected to the boom and the turret.

The boom desirably is a telescoping extendable and retractable boom having at least two sections, which can be hydraulically extended and retracted.

More specifically, there is provided a pedestal crane having a vertical tower with a boom adjacent the upper end comprising (a) a vertically positioned tower first section having a lower end secured to a foundation; (b) the boom base section having a see-saw beam mounted thereon to pivot about an axis longitudinal to the boom; (c) means to releasably secure the load lifting end of a telescoping multiple section hydraulically extendable and retractable boom, the boom having a base section and at least one extendable section, to a lower portion of the tower first section so that the boom load lifting end can pivot about a horizontal axis; (d) means to releasably secure the boom vertically to the tower first section near the top of the tower first section; (e) means to hydraulically extend the boom upwardly, with the boom load lifting end section stationary, so that the boom extends vertically upwardly a substantial distance above the top of the tower first section; (f) means to raise a second tower section by means of the see-saw beam and lifting lines to place it on top of the tower first section and join the first and second tower sections together; (g) means to attach a temporary boom support to the upper part of the tower second section and releasably secure the boom base section to it so that the load lifting end can be released from the tower lower portion; (h) means to retract the boom with vertically upward displacement of the boom load lifting end and means releasably securing the boom load lifting end to the tower; (i) means to secure the boom upper portion against excessive lateral movement when the temporary boom support is disconnected from the boom and the tower; (j) means to hydraulically extend the boom upwardly, with the boom end section stationary, so that the boom can extend vertically upwardly above the top of the tower second section; (k) means to releasably secure the boom upper sliding support to the tower second section upper portion; (l) means including the see-saw beam to raise a pedestal comprising an adapter and boom turret to the top of the tower, the adapter having an upper portion rotatably mounted on bearing means supported by a lower portion and means for releasably securing the adapter lower portion to the tower top; (m) the boom turret being pivotally joined to the top of the adapter to rotate about a horizontal axis; (n) means to release the upper part of the boom from the tower and position the boom base end adjacent the boom turret, means for tilting the boom turret into close contact with the boom base end and means joining the turret to the boom base end by a horizontal boom footpin; (o) means for rotating the tilted turret into contact with the adapter upper portion top end and means releasably securing the turret to the adapter; and (p) means for pivoting the boom vertically about the horizontal boom footpin.

According to a second aspect of the invention, a method of installing a hydraulic boom on the top of a high vertical tower boom support is provided comprising vertically positioning a first tower section and securing the tower section to a base; installing a plurality of additional tower sections in consecutive order on top of the first tower section and securing the adjoining sections together until a tower is erected having a desired height; releasably attaching a boom, having a base section, at least one extendable section and a load lifting end, in vertical position to and along side the tower as it is erected with the boom load lifting end at the bottom; jumping the boom vertically upwardly by alternately extending and retracting various boom sections as the tower sections are installed; positioning the boom base end adjacent the boom turret, tilting the boom turret into close contact with the boom base end and joining the turret to the boom base end by a horizontal boom footpin; releasing the boom lifting end from the tower; tilting the turret into contact with the adapter upper portion top end and releasably securing the turret to the adapter; and connecting means to the boom for pivoting the boom vertically about the horizontal boom footpin.

More specifically, the invention provides a method of erecting a pedestal crane having a vertical tower with a boom adjacent the upper end comprising (a) securing the lower end of a vertically positioned tower first section to a foundation; (b) releasably securing the outer load lifting end of a telescoping multiple section hydraulically extendable and retractable boom so that the boom load lifting end can pivot about a horizontal axis; (c) the boom having a base section, at least one extendable section and a load lifting end; (d) the boom base section having a see-saw beam mounted thereon to pivot about an axis longitudinal to the boom; (e) raising the boom to vertical position; (f) hydraulically extending the boom upwardly, with the boom load lifting end section stationary, so that the boom extends vertically upwardly a substantial distance above the top of the tower first section; (g) releasably securing the boom to the tower first section near the top of the tower first section by a boom upper sliding support on the boom; (h) raising a second tower section by means of the see-saw beam and lifting lines, placing it on top of the tower first section and joining the first and second tower sections together; (i) attaching a temporary boom support to the upper part of the tower second section and releasably securing the boom base section to it and then releasing the boom from the tower where it was previously secured thereto; (j) retracting the boom with vertically upward displacement of the boom load lifting end and releasably securing the boom load lifting end to the tower; (k) securing the boom upper portion against excessive lateral movement and disconnecting the temporary boom support from the tower and the boom; (l) hydraulically extending the boom upwardly, with the boom load lifting end section stationary, so that the boom extends vertically upwardly a substantial distance above the top of the tower second section; (m) releasably securing the boom upper sliding support to the tower second section upper portion; (n) repeating steps (f) to (m) when necessary to increase the height of the tower; (o) by use of the see-saw beam raising a pedestal comprising an adapter and boom turret to the top of the tower, the adapter having an upper portion rotatably mounted on bearing means supported by a lower portion, and releasably securing the adapter lower portion to the tower top; (p) the boom turret being pivotally joined to the top of the adapter to rotate about a horizontal axis; (q) releasing the upper part of the boom from the tower and positioning the boom base end adjacent the boom turret, tilting the boom turret into close contact with the boom base end and joining the turret to the boom base end by a horizontal boom footpin; (r) releasing the boom lifting end from the tower; (s) connecting means to the boom for pivoting the boom vertically about the horizontal boom footpin; (t) rotating the tilted turret into contact with the adapter upper portion top end and releasably securing the turret to the adapter; and (u) fixedly securing the see-saw beam to the boom so it is stationary.

The invention also includes a method of erecting a pedestal crane having a vertical tower with a boom adjacent the upper end comprising (a) securing the lower end of a vertically positioned tower first section to a foundation; (b) releasably securing the outer load lifting end of a telescoping multiple section hydraulically extendable and retractable boom to the tower first section by a lower boom support so that the boom outer end can pivot about a horizontal axis; (c) the boom having a base section, at least one boom extending section and an end section having the load lifting end; (d) the boom base section having a see-saw beam mounted thereon to pivot about an axis longitudinal to the boom; (e) raising the boom in a retracted condition to vertical position; (f) hydraulically extending the boom upwardly, with the boom end section stationary, so that the boom extends vertically upwardly a substantial distance above the top of the tower first section; (g) releasably securing the boom near the top of the tower first section by a boom upper sliding support on the boom; (h) raising a second tower section by means of the see-saw beam and lifting lines thereon, placing it on top of the tower first section and joining the first and second tower sections together; (i) attaching a temporary boom support to the upper part of the tower second section and releasably securing the boom base section to it and then releasing the lower boom support and the boom upper sliding support from the tower to thereby release the boom from the tower where it was previously secured thereto by them; (j) retracting the boom with vertically upward displacement of the boom load lifting end and releasably securing the boom load lifting end to the tower second section by means of the lower boom support; (k) securing the boom upper portion against excessive lateral movement and disconnecting the temporary boom support from the tower and the boom; (l) hydraulically extending the boom upwardly, with the boom end section stationary, so that the boom extends vertically upwardly a substantial distance above the top of the tower second section; (m) releasably securing the boom upper sliding support to the tower second section upper portion; (n) repeating steps (f) to (m) when necessary to increase the height of the tower; (o) by use of the see-saw beam raising a pedestal comprising an adapter and boom turret to the top of the tower, the adapter having an upper portion rotatably mounted on bearing means supported by a lower portion, and releasably securing the adapter lower portion to the tower top; (p) the boom turret being pivotally joined to the top of the adapter to rotate about a horizontal axis; (q) releasing the upper part of the boom from the tower by separating the boom upper sliding support from the tower, positioning the boom base end adjacent the boom turret, tilting the boom turret into close contact with the boom base end and joining the turret to the boom base end by a horizontal boom footpin; (r) releasing the boom lifting end from the tower; (s) connecting boom lifting hydraulic means to the turret and the boom; (t) rotating the tilted turret into contact with the adapter upper portion top end and releasably securing the turret to the adapter; and (u) fixedly securing the see-saw beam to the boom so it is stationary.

BRIEF DESCRIPTION OF THE DRAWINGS

FIGS. 5 to 8 also illustrate the steps to be repeated in erecting additional tower sections on the third, fourth etc. tower sections except for the top or uppermost tower section;

FIG. 10 illustrates the positioning of the pedestal boom turret when it is tilted and attached to the boom in the ninth step in erecting the pedestal crane shown in FIG. 1;

FIG. 11 illustrates the positioning of the boom turret to move the boom outwardly from the tower to attach the hydraulic cylinder to the boom and boom turret in the tenth step in erecting the pedestal crane shown in FIG. 1;

FIG. 12 illustrates the positioning of the boom turret secured to the top of the pedestal adapter with the boom horizontal in the eleventh step in erecting the pedestal crane shown in FIG. 1;

FIG. 13 is similar to FIG. 12 but illustrates the see-saw beam rotated into storage position along side the boom in the twelfth step in erecting the pedestal crane shown in FIG. 1;

FIG. 14 is a vertical section through the tower where two tower sections are joined together;

FIG. 15A is an end view of the boom load lifting end or boom tip taken along the line 15A—15A of FIG. 15;

FIG. 26 is an enlarged view of FIG. 5 showing the temporary boom support on top of a tower section and connected to the boom base section;

FIG. 27 is a detailed elevational view of the temporary boom support shown in FIG. 26;

FIG. 28 is a plan view of the temporary boom support taken along the line 28—28 of FIG. 27;

FIG. 33 is a sectional view taken along the line 33—33 of FIG. 31; and FIG. 34 is a sectional view taken along the line 34—34 of FIG. 31.

DETAILED DESCRIPTION OF THE DRAWINGS

To the extent it is reasonable and practical the same or similar elements which appear in the various views of the drawings will be illustrated by the same number.

Figure 1:
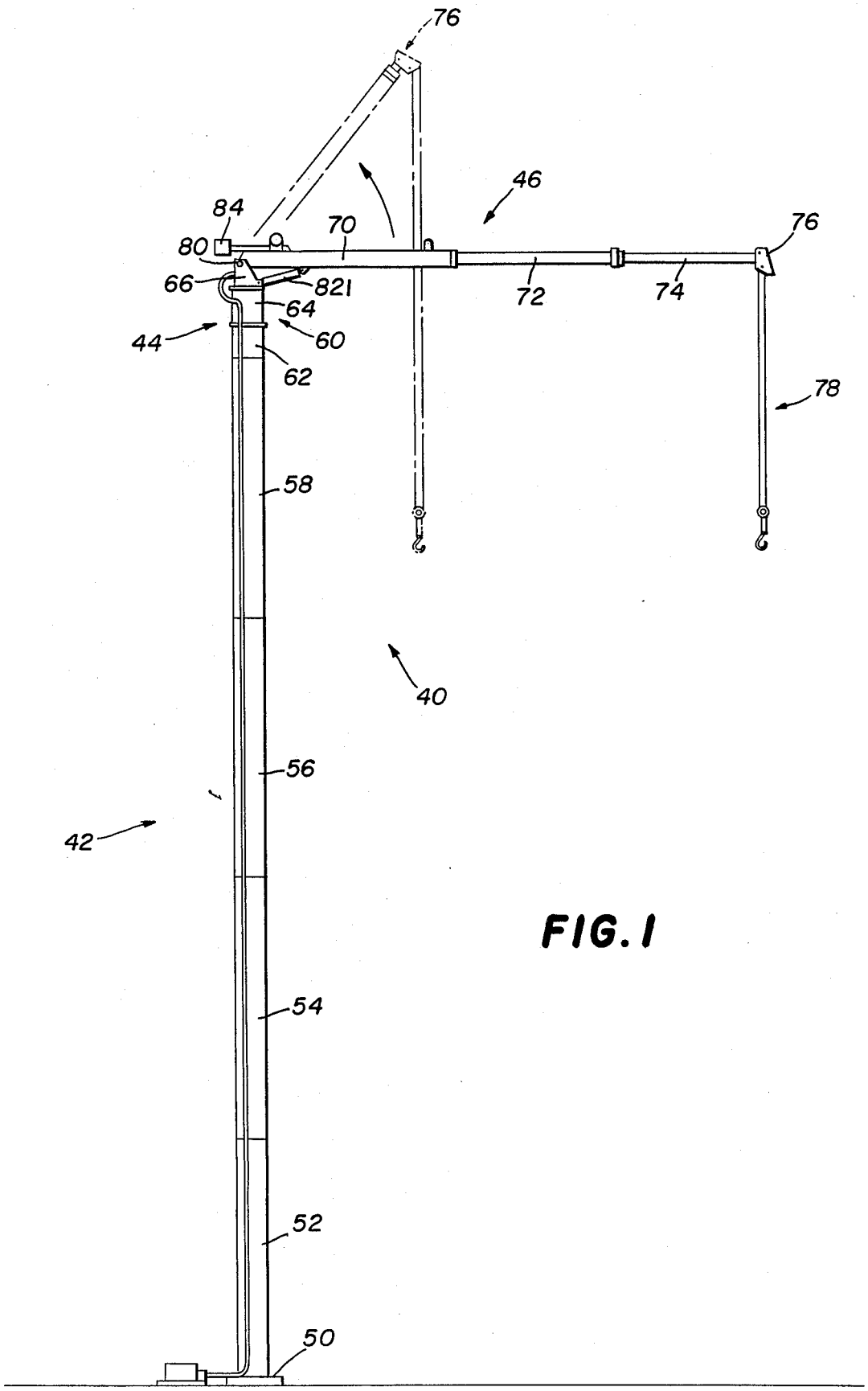
FIG. 1 is an elevational view of a pedestal crane provided by the invention.
Figure 2:
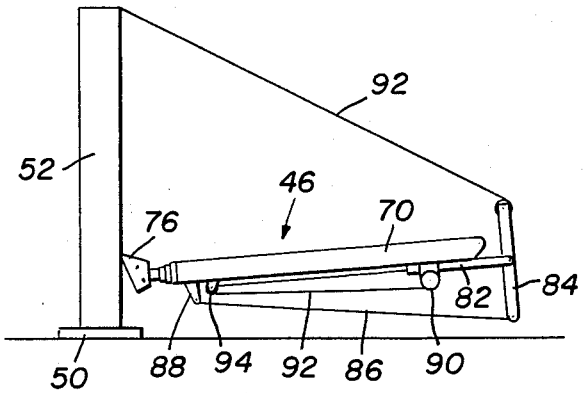
FIG. 2 illustrates the positioning of the first tower section and the boom in the first step in erecting the pedestal crane shown in FIG. 1.

With reference to FIG. 1, the pedestal crane 40 has a tower 42 on top of which pedestal 44 is mounted. The base section of boom 46 is pivotally mounted to the top of the pedestal 44 so that it can pivot about a horizontal axis to be raised and lowered.

The tower 42 is erected on the site where the pedestal crane is to be used and simultaneous with erection of the tower the boom 46 is raised by jumping it upwardly along the tower as the tower height is increased.

The tower as illustrated in FIG. 1 has a first or base section 52 which has its lower end removably connected to a foundation 50. A tower second section 54, which may also be called a first intermediate section, is positioned on top of the tower base section and the upper end of the base section 52 is releasably joined to the lower end of the tower second section 54. Similarly, a tower third section 56, which may also be called a second intermediate section, is positioned on top of the tower second section 54 and the upper end of the tower second section is releasably joined to the lower end of the tower third section 56. It should be understood that for some construction projects where a tower of lesser height is adequate that one or more of the tower sections can be eliminated. Even the tower base section 52 can be eliminated if found unnecessary for a particular job.

The tower top or fourth section 58 is shown mounted on top of the tower third section 56. The lower end of the tower top section 58 is releasably joined to the upper end of tower third section 56.

All of the tower sections are desirably tubular and contain internal ladders for a workman to climb to the top. Each tower section can be thirty-two feet long and four feet in diameter.

Releasably mounted on the upper end of tower top section 58 is pedestal 44 which comprises an adapter 60 having a lower portion 62 and an upper portion 64. The upper portion 64 is rotatably supported on the adapter stationary lower portion 62 so that the upper portion 64 can rotate about a vertical axis in either direction for about 360°. The extent of rotation is only limited, if at all, by hydraulic and/or electric lines extending from the tower to the boom.

The adapter 60 has a boom turret 66 mounted on the top of the adapter upper portion 64. Boom 46 has a base section 70, an intermediate section 72 and an outer section 74 with a load lifting end or boom tip 76 with suitable block and tackle 78. The boom base section 70 is joined to the boom turret 66 by a horizontal footpin 80, thereby permitting the boom to be raised and lowered vertically by hydraulic cylinder 821 which is connected at one end to boom base section 70 and at the other end to boom turret 66.

The boom 46 is of the type generally referred to as a telescoping multiple section hydraulically extendable and retractable boom and is commercially available from a plurality of sources. Boom section 72 telescopes into section 70 and section 74 telescopes into section 72. Suitable hydraulic cylinders and ancillary equipment is located in the boom so that the boom sections can be hydraulically extended and retracted individually relative to adjacent sections. When fully extended the boom will be about sixty to seventy feet long.

A sequence of steps to be followed to assemble and erect the pedestal crane shown in FIG. 1 is illustrated by FIGS. 2 to 13. To dismantle the pedestal crane, the erection steps are followed in reverse.

After the foundation 50 is installed, the tower base section 52 is raised into position and releasably secured to it. Only simple equipment is needed for this operation. The boom 46 is then moved into the position shown in FIG. 2 and the boom load lifting end or boom tip 76 is inserted into a lower boom support 130, desirably positioned in the lower end of each tower section 52–58 (FIGS. 15–18, 26). The boom base section 70 has a pipe 82 axially mounted on the outer end thereof so that it can rotate about its axis. A see-saw beam 84 is pivotally mounted laterally on the end of pipe 82. A see-saw beam back stay line 86 extends from one end of the beam to a pivoting back tie bracket 88 on the boom base section 70. Hoist or winch 90 is also mounted on boom base section 70. A hoist cable 92 extends from hoist 90 to lead sheave 94, also on boom section 70, and from it to sheaves in see-saw beam 84 and then to the top of tower section 52. By means of the hoist 90 and cable 92 the boom 46 is tipped-up vertically into position along side tower base section 52. Since pipe 82 can be rotated, the load to be lifted can be picked up along side the tower and then pipe 82 can be rotated about its axis to place the load on top of the tower.

Figure 3:
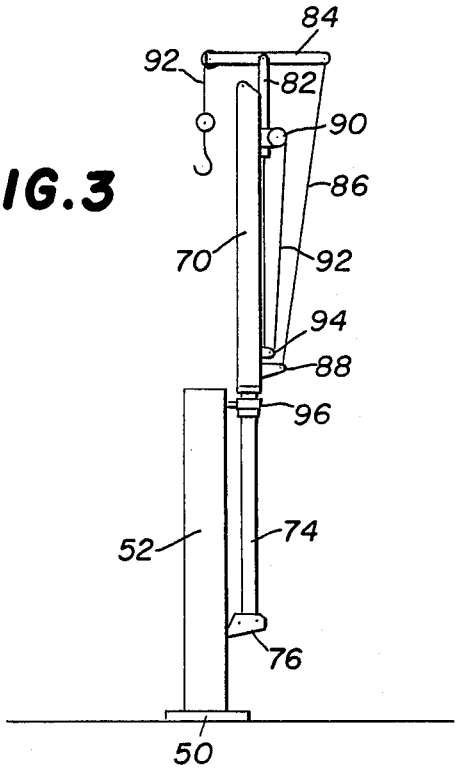
FIG. 3 illustrates the positioning of the first tower section and the boom in the second step in erecting the pedestal crane shown in FIG. 1.
Figure 20:
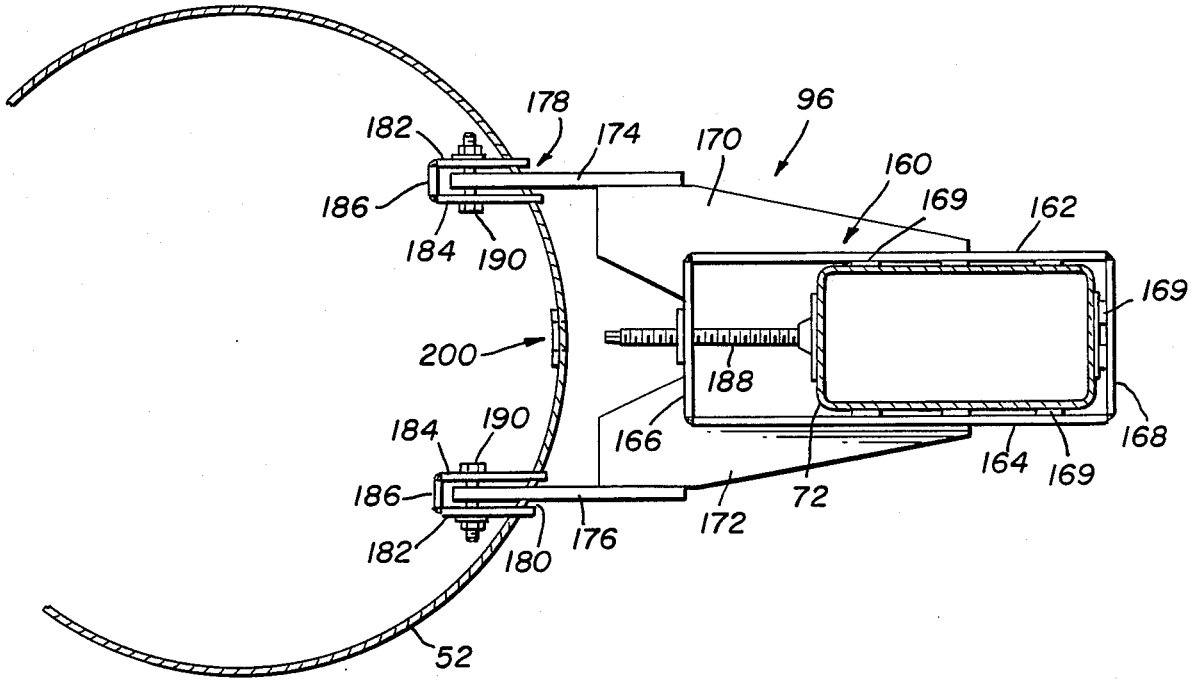
FIG. 20 is a sectional view taken along the line 20—20 of FIG. 19.
Figure 19:
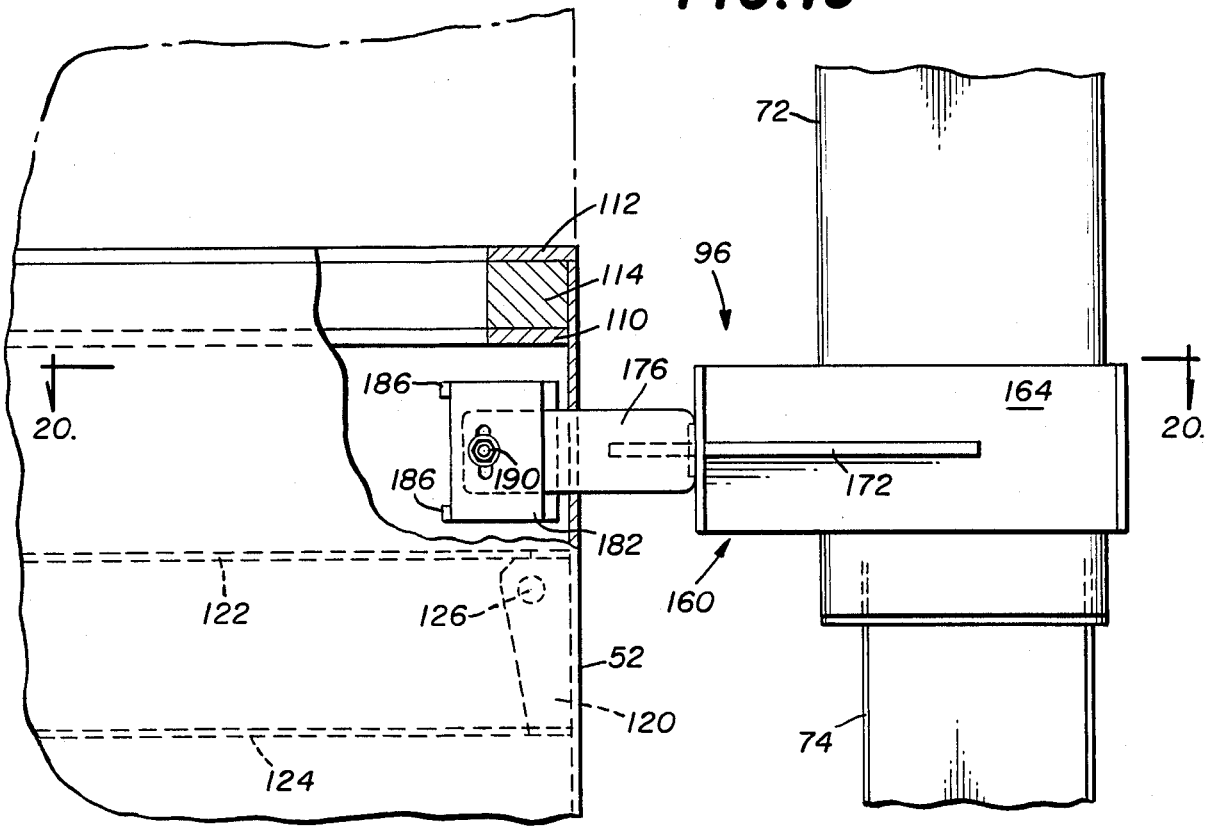
FIG. 19 is an elevational view, partially in section, of the boom sliding support shown attached to the boom and a tower section.

In step two, after the boom has been tipped-up, boom end section 74 is extended, thereby raising the boom vertically, and the boom upper sliding support 96, which is removably attached to the outer end of boom section 72, is releasably attached to the upper portion of tower base section 52 (FIGS. 3, 19 and 20). This sliding support 96 and the basket 130 keep the boom vertical.

Figure 4:
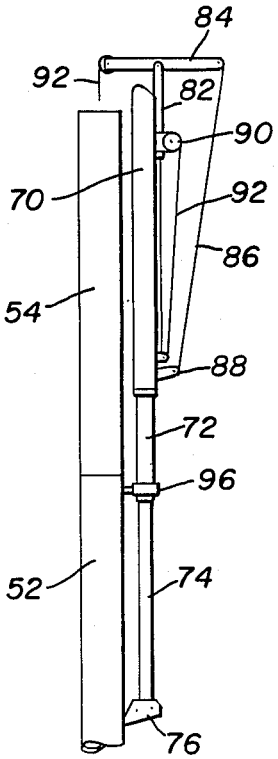
FIG. 4 illustrates the positioning of the first and second tower sections and the boom in the third step in erecting the pedestal crane shown in FIG. 1.

The boom 46, in step three, is further extended vertically (FIG. 4) by extending boom section 72 out of boom section 70. The tower second section 54 is then lifted into position onto the top of tower base section 52 by means of cable 92, see-saw beam 84 and hoist 90 (FIG. 4). The adjoining ends of the two tower sections are then releasably connected together (FIG. 14).

Figure 5:
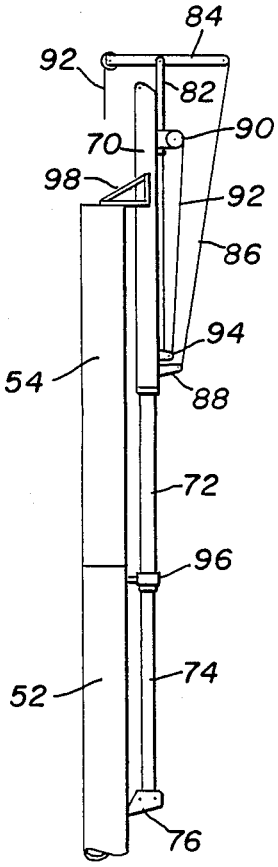
FIG. 5 illustrates the positioning of the first and second tower sections and the boom in the fourth step in erecting the pedestal crane shown in FIG. 1.

In the fourth step, a boom temporary support 98 is first placed on top of the tower second section 54 by means of hoist 90, cable 92 and the see-saw beam 84 (FIGS. 5, 27, 28). The boom temporary support 98 is removably mounted on the tower section 54 and releasably connected to the boom section 70.

Figure 6:
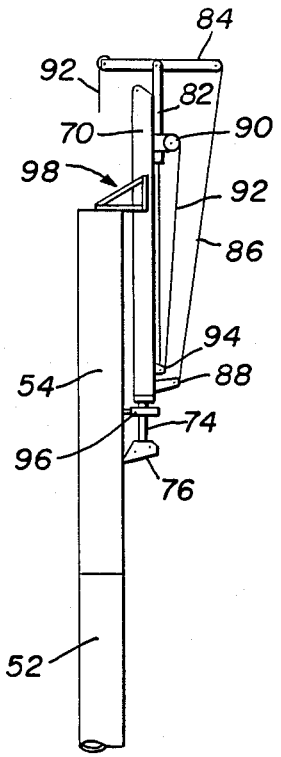
FIG. 6 illustrates the positioning of the first and second tower sections and the boom in the fifth step in erecting the pedestal crane shown in FIG. 1.

In the next or fifth step, the sliding support 96 is released from tower section 52 and the boom sections 72,74 are retracted while the boom base section 70 is held stationary by the boom temporary support 98 (FIG. 6). The boom load lifting end or boom tip 76 is then inserted into a lower boom support 130 in the lower portion of tower second section 54.

In the sixth step in erecting the pedestal crane the boom is stabilized against excessive lateral movement by suitable means. Although the boom base section 70 can be lashed to the tower by means of a cable and shackles so that the boom can still be moved vertically but is stabilized against excessive lateral movement when the boom temporary support is removed, it is desirable to use a boom jumping guide. A suitable boom jumping guide 300 for this purpose is illustrated by FIGS. 31 to 34.

The boom jumping guide 300 has a pair of angled arms 302,304 which are essentially mirror images of each other. Angled arm 302 comprises a flat angled bar 306 which is reinforced along its outer edge and end by a vertical flange 308. Similarly, angled arm 304 comprises a flat angled bar 310 which is reinforced along its outer edge and end by a vertical flange 312. The two arms 302,304 are pivotally connected together by a bolt 314 which is located in matching holes in the angled bars 306,310. When so joined the two arms are movable in a scissors-like action. The inner end of bar 306 is provided with a hole through which a bolt 316 extends and is removably joined to ring plates 110,112 on top of each tower section. The inner end of bar 310 is also provided with a hole through which a bolt 318 extends and is removably joined to ring plate 112. The inner ends of the angled arms 302,304 fit between the arms 230,232 (FIG. 28) of the boom temporary support 98 (to be subsequently described in detail) and the outer ends of angled arms 302,304 fit below said arms 230,232 when both the boom jumping guide 300 and the boom temporary support 98 are simultaneously connected to the top of a tower section. The jumping guide 300 is put in position by rotating the outer arms 302,304 into position on each side of the boom and then bolting the inner ends thereof to the tower top. When the boom jumping guide 300 is removably secured to the top of a respective tower section as described the outer ends of the guide are located on each side of the boom base section 70. Angled arm 302 has a roller 320 mounted on the side, and a roller 322 mounted on the end, so that they are located close to but spaced slightly away from the boom surface. Similarly, the angled arm 304 has a roller 324 mounted on the side, and a roller 326 mounted on the end, so that they are located close to but spaced slightly away from the boom surface. By positioning the boom jumping guide 300 as described, the boom is stabilized against excessive lateral movement yet it is free to move vertically free of restraint. Then the boom temporary support 98 is released from the top of tower section 54 and boom section 70 and removed by means of cable 92 on see-saw beam 84. The boom section 72 is then extended to raise the boom. The boom sliding support 96 is then attached to the upper portion of tower section 54 by attaching means identical to that on tower section 52 (FIGS. 7, 19 and 20).

Figure 8:
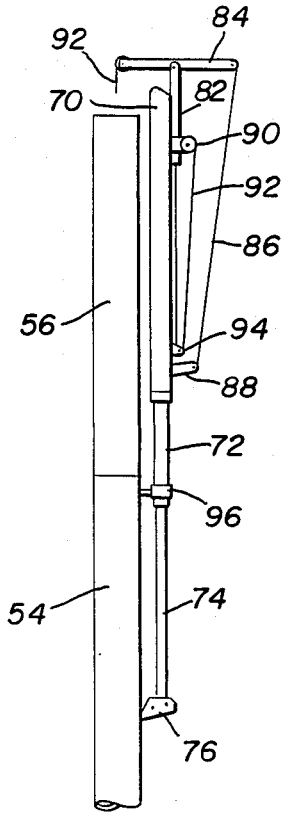
FIG. 8 illustrates the positioning of the second and third tower sections and the boom in the seventh step in erecting the pedestal crane shown in FIG. 1.

A third tower section is installed in the seventh erection step (FIG. 8). The third section can be another tower intermediate section 56, like section 54, or it can be a tower top section 58, depending on the desired tower height. The boom is first further raised by extending boom section 72, which causes boom base section 70 to rise while boom section 72 is stationary, to position the see-saw beam high enough to lift tower section 56 or 58 into position by means of the see-saw beam, cable 92 and hoist 90. The tower section is then removably joined to the tower section 54 immediately beneath it. Additional tower intermediate sections like 54,56 can be installed as required to assemble a tower near the desired height. Then the tower top section 58 is installed in the same manner.

Figure 7:
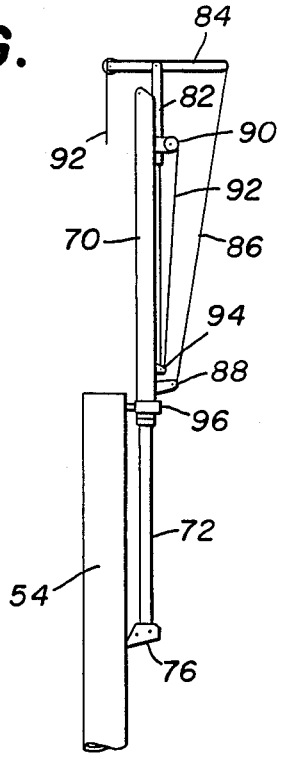
FIG. 7 illustrates the positioning of the first and second tower sections and the boom in the sixth step in erecting the pedestal crane shown in FIG. 1.
Figure 9:
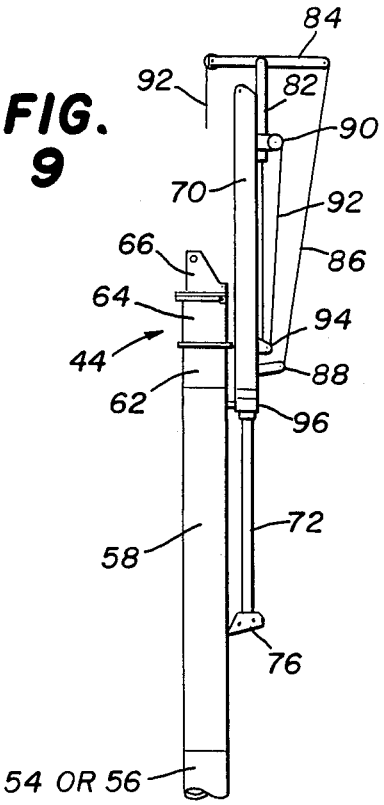
FIG. 9 illustrates the positioning of the tower top section, with the pedestal on the top thereof, and the boom in the eighth step in erecting the pedestal crane shown in FIG. 1.
Figure 15:
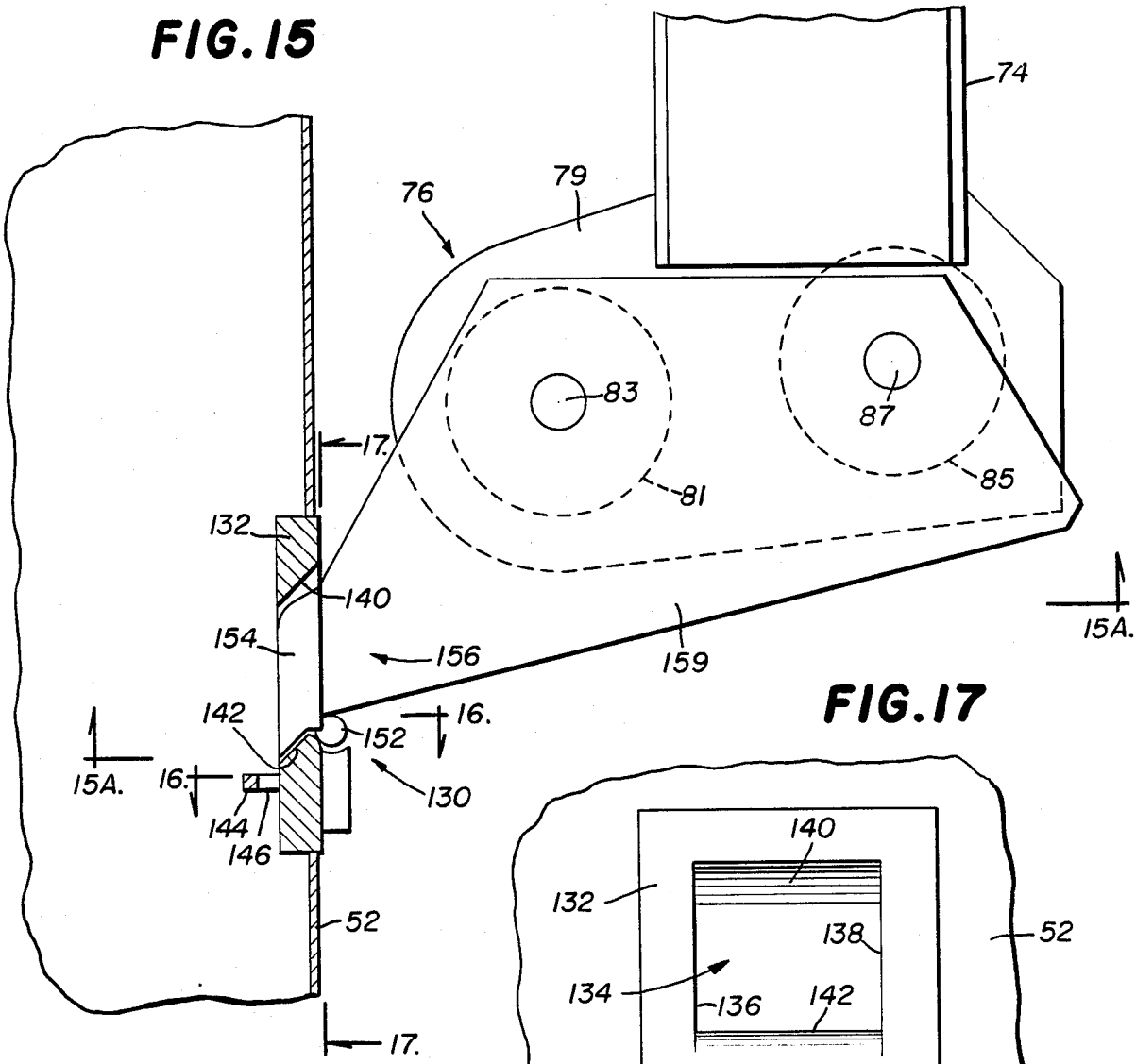
FIG. 15 is an elevational view, partially in section, showing the boom load lifting end or boom tip positioned in a support on a tower section.
Figure 17:
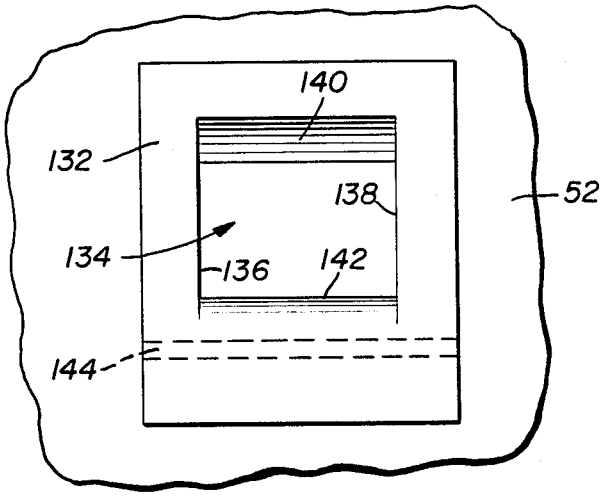
FIG. 17 is an elevational view taken along the line 17—17 of FIG. 15.
Figure 16:
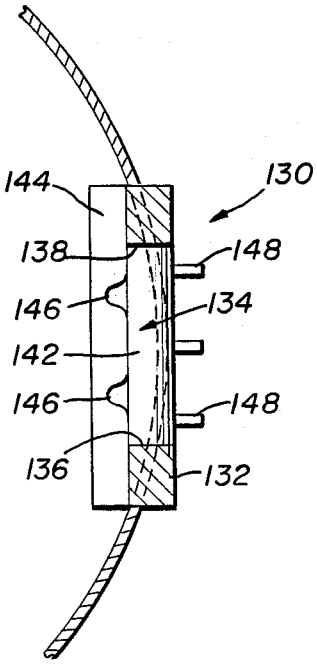
FIG. 16 is a sectional view taken along the line 16—16 of FIG. 15.
Figure 18:
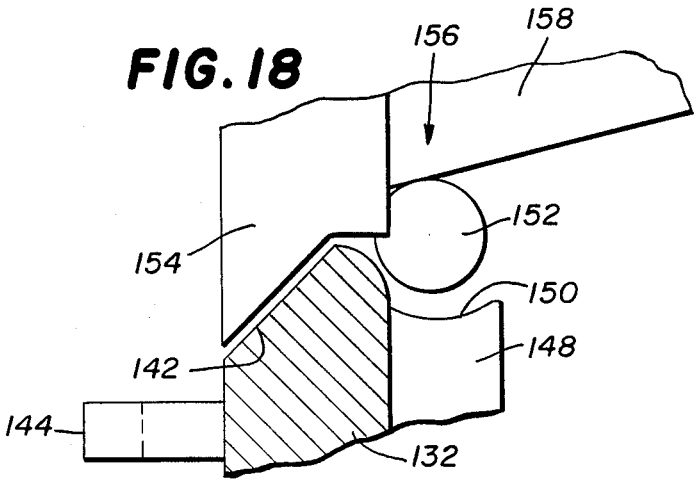
FIG. 18 is an enlarged view of the lower boom support for the boom load lifting end or boom tip as shown in FIG. 15.

In the eighth step in the tower erection, after the tower top section 58 is in place, the boom is brought into position thereon in the same way the boom is brought into position on tower section 54 as shown in FIG. 7. Then the pedestal 44 is removably installed on top of tower section 58 as shown in FIG. 9. The pedestal 44 is readily lifted into place by use of the see-saw beam 84, cable 92 and hoist 90. The pedestal 44 includes an adapter 60 having a lower portion 62 and an upper portion 64 rotatably mounted on the lower portion 62. The lower portion 62 is removably mounted on the top of tower section 58. Mounted on top of adapter upper portion 64 is a boom turret 66.

In the ninth step of the erection procedure, the boom is stabilized against excessive lateral movement by placing the boom jumping guide 300 in removable position on top of the tower section as already described previously. Then the boom sliding support 96 is removed from the tower section and boom section 72. The boom sections 72,74 are then retracted to lower the boom until the base end of boom section 70 is adjacent the boom turret 66. The boom turret 66 is then tilted towards the boom base end until a footpin 80 can be installed to pivotally connect the boom turret 66 to the boom base end of boom section 70 (FIG. 10).

Figure 30:
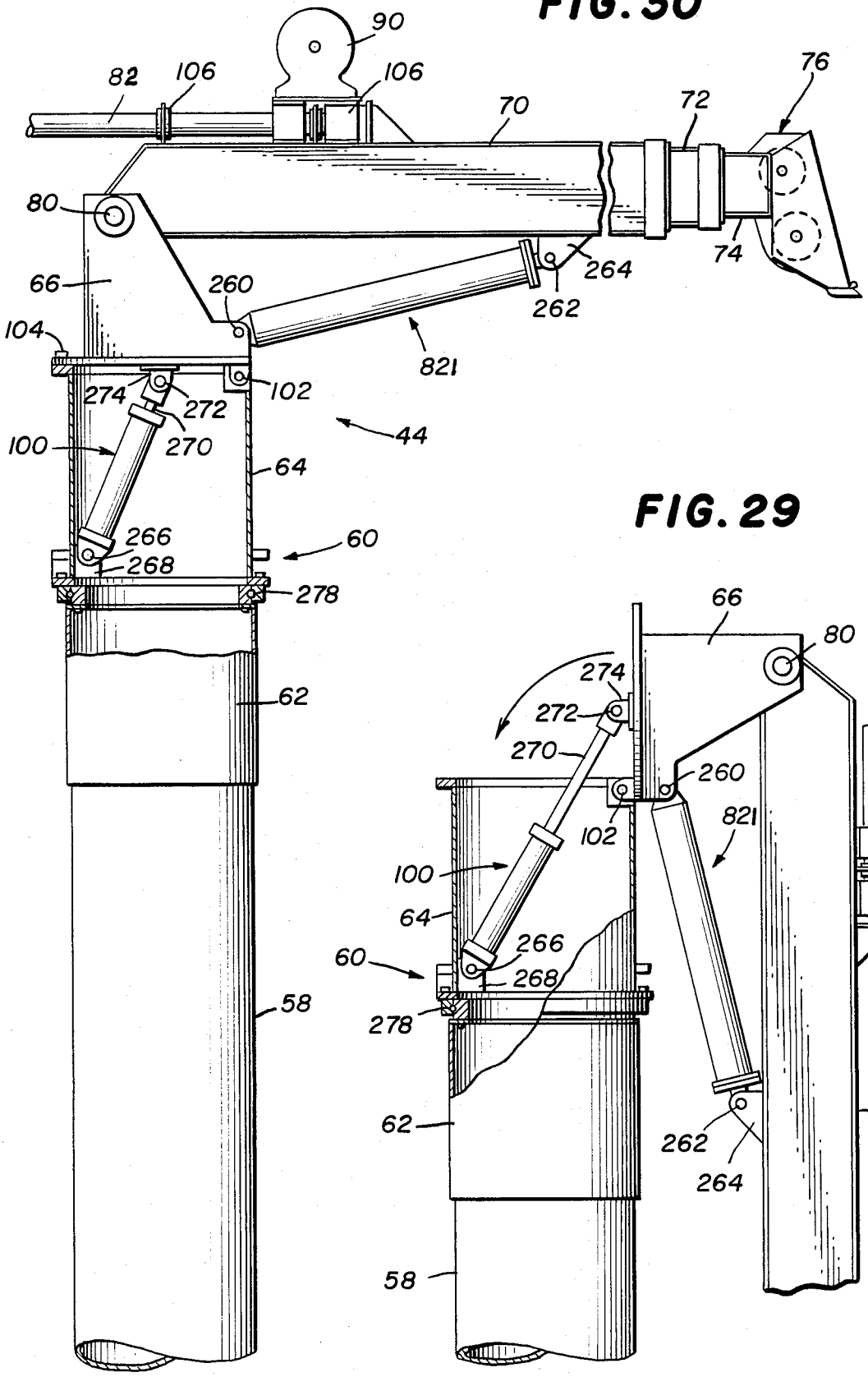
FIG. 30 is an enlarged elevational view of a portion of FIG. 13 but with the boom retracted.
Figure 29:
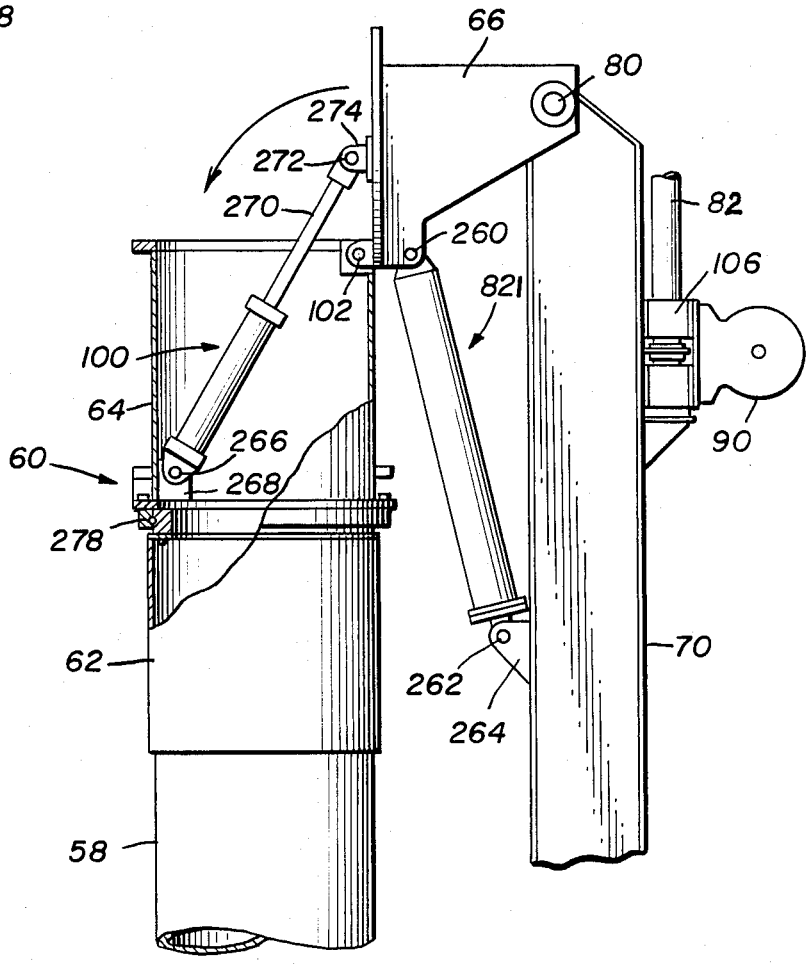
FIG. 29 is an enlarged elevational view of a portion of FIG. 11.
Figure 31:
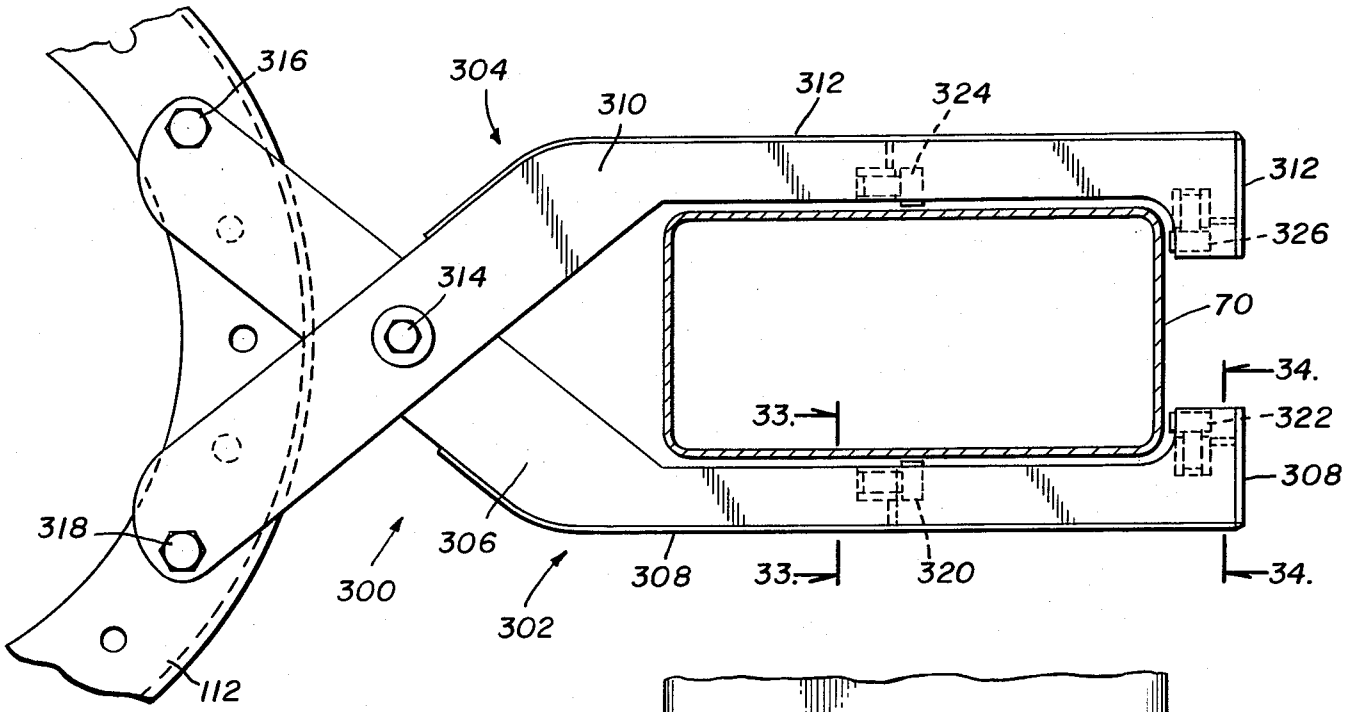
FIG. 31 is a plan view of a boom jumping guide used to stabilize the boom against excessive lateral movement when the temporary boom support is removed.
Figure 32:
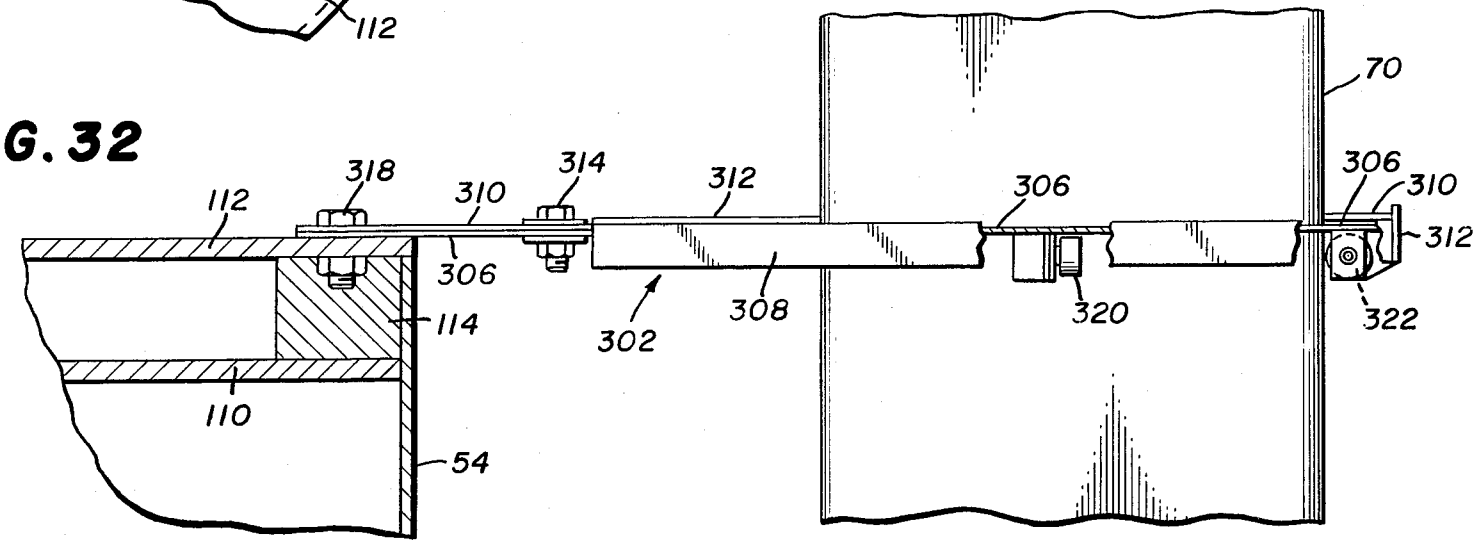
FIG. 32 is a side elevational view of the boom jumping guide shown in FIG. 31.

FIG. 11 illustrates the tenth step in the pedestal boom erection procedure. The boom load lifting end 76 is withdrawn from the lower boom support 130 in tower section 58 and then is pushed outwardly away from the tower to provide room for the installation of boom lift hydraulic cylinder 82 which extends from boom section 70 to boom turret 66. An additional hydraulic cylinder 100 is installed extending from the base of boom turret 66 to the inside of adapter upper portion 64 (FIGS. 29 and 30). The hydraulic cylinder 100 is used to rotate or tilt the boom turret up or down about horizontal pin 102.

Following installation of the hydraulic cylinders 82,100 in the eleventh step, the boom turret 66 is retracted by means of hydraulic cylinder 100 to bring the turret base into contact with the adapter top portion 64. The turret 66 and adapter top portion 64 are then releasably connected together by bolts 104 (FIGS. 12 and 30).

In the twelfth step, the back stay line 86 is released from the see-saw beam 84. The beam is rotated ninety degrees by rotation of pipe 82, which is mounted in supports 106 which permit such rotation. The see-saw beam 84 is then pivoted ninety degrees into parallel alignment with boom section 70 and then is secured to it for subsequent use when the pedestal boom is dismantled. Hydraulic lines and other auxiliary equipment is then installed as may be necessary to place the pedestal crane in operation.

To dismantle the pedestal crane the described steps are followed in reverse.

FIG. 14 illustrates one way in which the adjoining ends of two tower sections, such as 52,54, can be releasably joined together. The upper end of tower section 52, and the other tower sections, is provided with an internal horizontal ring 110 and an outer ring 112 located on the end of the tower section. Metal blocks 114 are positioned between the rings 110,112 which are welded to the tower section. Vertical holes are provided in the rings and blocks to receive bolts 116. The tower section 54 lower end has similar rings 120,122 and blocks 124. A worker standing on a platform (not shown) inside of tower section 52 can install and remove the bolts.

Also as shown in FIG. 14, the upper end of each tower section 52–58 can be provided with vertical ribs 125 welded to the tower section between top and bottom rings 127,128. Holes 126 are located in ribs 125 to fasten guy lines thereto through slots (not shown) in the tower section wall. In this way the tower can be further secured as it is erected and stabilized in use.

The boom load lifting end or boom tip 76 includes a pair of spaced apart plates 77,79 (FIG. 15A) which are joined to the boom section 74. Pulley or sheave 81 is mounted between plates 77,79 on shaft 83. Pulley or sheave 85 is likewise mounted between plates 77,79 but on shaft 87. Plate 158 is mounted on the outside of plate 77 and plate 159 is mounted on the outside of plate 79. Round bar 152 is mounted on the bottom forward edge of plates 158,159.

FIGS. 15 to 18 show further details of the lower boom support 130 located in the lower portions of each of the tower sections 52–58. The lower boom support 130 includes a thick vertical plate 132 positioned in a cut-out in the tower section. The plate 132 in turn has a generally rectangular opening 134 with vertical sides 136,138. The upper horizontal side 140 of opening 134 is downwardly and inwardly sloped. The lower horizontal side 142 of opening 134 is also downwardly and inwardly sloped. On the inside surface of plate 132, beneath opening 134, a horizontal bar 144 is welded in place. Two spaced apart openings 146 are provided in bar 144 to receive tapered pins (not shown) which prevent the end of the boom from protruding too far into the tower. Three vertical spaced apart bars 148 are welded on plate 132 beneath opening 134 and the upper end of each bar 148 is made concave 150 to supportably receive round bar 152 mounted beneath the nose portions 156 of plates 158,159 on the boom end 76. A lateral plate 154 is connected to the ends of plates 158, 159. The lower end of plate 154 is sloped to rest on surface 142.

The lower boom support 130 just described provides a rapid means for supportably positioning the outer or load lifting end of the boom on a tower section so that the boom can be extended upwardly for use in erecting the tower. The lower boom support 130 also provides for ready removal of the boom end from the support 130 so that the boom can be jumped upwardly into position to raise and position the next tower section.

FIGS. 19 and 20 illustrate further details of the boom sliding support 96. It has a vertical rectangular tubular member 160 with opposing side walls 162,164 and end walls 166,168. Vertical wear strips 169 are positioned on the inside of walls 162,164,168. The wear strips also facilitate sliding of the support 96 on the boom section 72. A large set screw 188 threadably engages wall 166 and extends into releasable contact with the bottom surface of boom section 72. A porthole 200 is provided in the tower section so that set screw 188 can be turned from inside the tower section. The side walls 162,164 each has a horizontal flange 170,172 to which vertical plates 174,176 are respectively joined. A pair of vertical spaced apart slots 178,180 are cut in the tower section 52. Each of these slots is lined with a pair of spaced apart plates 182,184 which are reinforced at the back by horizontal bars 186. The ends of vertical plates 174,176 fit into the slots 178,180 and are releasably connected by bolts 190 to the adjacent plates 182,184. In this way a worker inside of the tower can connect and disconnect the sliding support.

Figures 21, 22, 23, 24, 25:
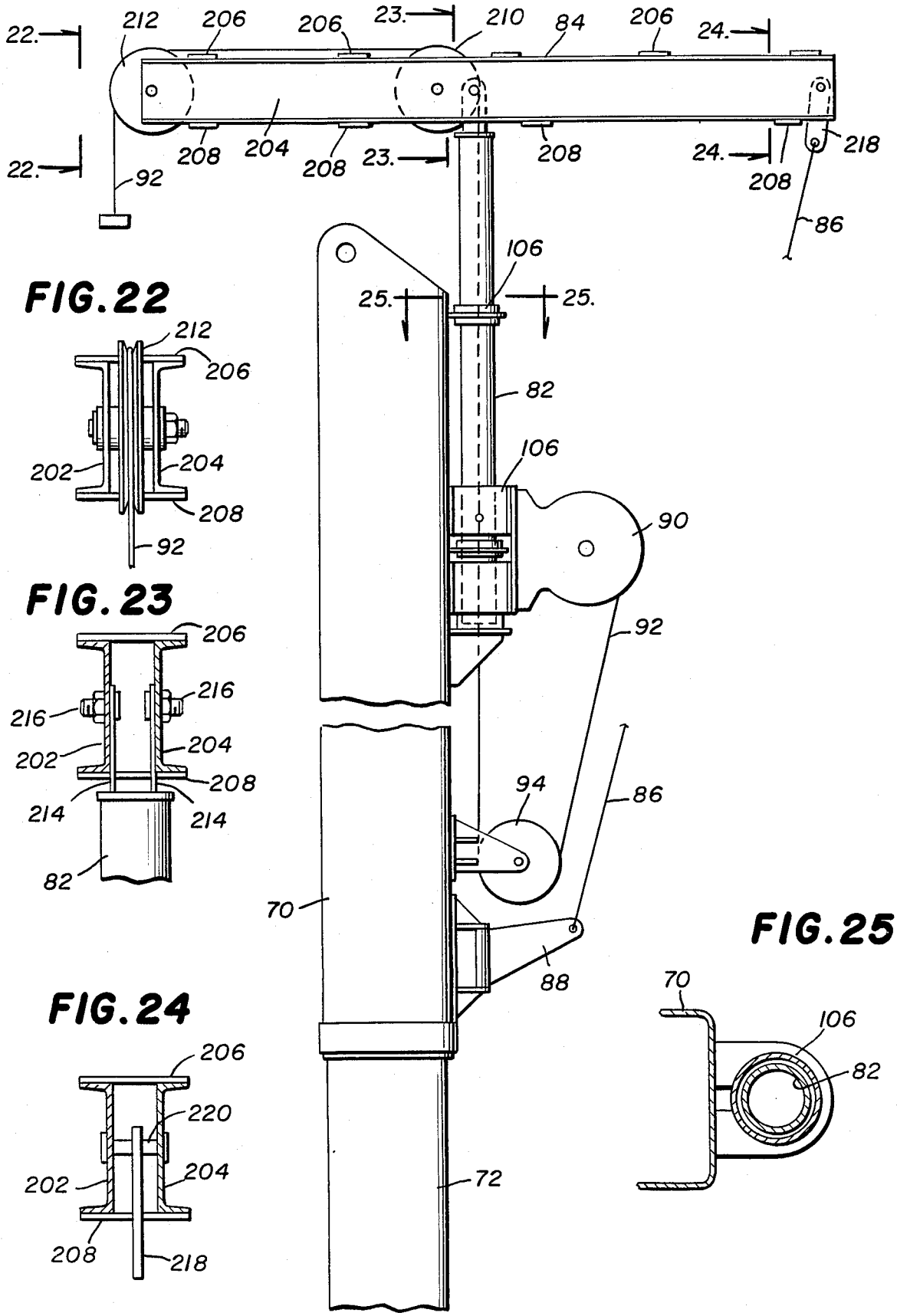
FIG. 21 is an elevational view of the boom base section showing the see-saw beam and the hoist or winch mounted thereon.
FIG. 22 is an end view taken along the line 22—22 of FIG. 21.
FIG. 23 is a sectional view taken along the line 23—23 of FIG. 21.
FIG. 24 is a sectional view taken along the line 24—24 of FIG. 21.
FIG. 25 is a sectional view taken along the line 25—25 of FIG. 21.

FIGS. 21 to 25 illustrate further details of the see-saw beam 84 which is fabricated from two spaced apart channel members 202,204 which are connected by upper strips 206 and lower strips 208. As shown in FIGS. 21 and 22 the see-saw beam 84 has a centrally located sheave 210 and an end sheave 212 over which the cable 92 runs from sheave 94 mounted on boom section 70.

The end of pipe 82 has a pair of fingers 214 on the upper or outer end thereof. The beam channel members 202,204 are pivotally connected to these fingers by bolts 216 (FIG. 23).

The back stay line 86 is effectively joined to see-saw beam 84 by means of strip 218 pivotally connected to the beam by pin 220 (FIGS. 21 and 24).

The pipe 82 is rotatably mounted in support brackets 106 as shown in FIG. 25. The pipe is located longitudinal to the boom. This permits rotation of the see-saw beam in a full circle unless otherwise restricted.

The boom temporary support 98 is illustrated in further detail in FIGS. 27 and 28. As shown in these drawings, the temporary support 98 has a pair of horizontal arms 230,232 made of structural angle stock. The respective outer ends of arms 230,232 have vertically extending legs 234,236 also made of structural angle stock. Slanted brace 238 extends from arm 230 to leg 234 and slanted brace 240 extends from arm 232 to leg 236. The arms 230,232 each have two holes so that they can be releasably joined by bolts 240 to the top of a tower section 54–58. Each of the legs 234,236 has a pair of vertically spaced apart horizontal plates 242, 244 which engage respectively with mounting plates 246,248 on opposing sides of boom section 70. Each adjacent pair of plates 242,246 and 244,248 is releasably connected together by a bolt 250.

FIGS. 29 and 30 show in enlarged detail the hydraulic cylinder arrangements 821,100 used to lift the boom 46 and pivot or tilt the boom turret 66. The hydraulic cylinder 821 is connected by pin 260 to boom turret 66 and the cylinder rod end is connected by pin 262 to flange 264 on boom section 70. The end of hydraulic cylinder 100 is connected by pin 266 to flange 268 on the inside of adapter upper portion 64. The end of piston rod 270 is connected by pin 272 to a flange 274 on the bottom of boom turret 66.

The adapter upper portion 64 is rotatably mounted on bearings 278 supported on the top of the adapter lower portion 62.

The foregoing detailed description has been given for clearness of understanding only, and no unnecessary limitations should be understood therefrom, as modifications will be obvious to those skilled in the art.

What is claimed is:

1. A method of erecting a pedestal crane having a vertical tower with a boom adjacent the upper end comprising:

(a) securing the lower end of a vertically positioned tower first section to a foundation;

(b) releasably securing the outer load lifting end of a telescoping multiple section hydraulically extendable and retractable boom so that the boom load lifting end can pivot about a horizontal axis;

(c) the boom having a base section, at least one extendable section and a load lifting end;

(d) the boom base section having a see-saw beam mounted thereon to pivot about an axis longitudinal to the boom;

(e) raising the boom to vertical position;

(f) hydraulically extending the boom upwardly, with the boom load lifting end section stationary, so that the boom extends vertically upwardly a substantial distance above the top of the tower first section;

(g) releasably securing the boom to the tower first section near the top of the tower first section by a boom upper sliding support on the boom;

(h) raising a second tower section by means of the see-saw beam and lifting lines, placing it on top of the tower first section and joining the first and second tower sections together;

(i) attaching a temporary boom support to the upper part of the tower second section and releasably securing the boom base section to it and then releasing the boom from the tower where it was previously secured thereto;

(j) retracting the boom with vertically upward displacement of the boom load lifting end and releasably securing the boom load lifting end to the tower;

(k) securing the boom upper portion against excessive lateral movement and disconnecting the temporary boom support from the tower and the boom;

(l) hydraulically extending the boom upwardly, with the boom load lifting end section stationary, so that the boom extends vertically upwardly a substantial distance above the top of the tower second section;

(m) releasably securing the boom upper sliding support to the tower second section upper portion;

(n) repeating steps (f) to (m) when necessary to increase the height of the tower;

(o) by use of the see-saw beam raising a pedestal comprising an adapter and boom turret to the top of the tower, the adapter having an upper portion rotatably mounted on bearing means supported by a lower portion, and releasably securing the adapter lower portion to the tower top;

(p) the boom turret being pivotally joined to the top of the adapter to rotate about a horizontal axis;

(q) releasing the upper part of the boom from the tower and positioning the boom base end adjacent the boom turret, tilting the boom turret into close contact with the boom base end and joining the turret to the boom base end by a horizontal boom footpin;

(r) releasing the boom lifting end from the tower;
(s) connecting means to the boom for pivoting the boom vertically about the horizontal boom footpin;
(t) rotating the tilted turret into contact with the adapter upper portion top end and releasably securing the turret to the adapter; and
(u) fixedly securing the see-saw beam to the boom so it is stationary.

2. A method of erecting a pedestal crane having a vertical tower with a boom adjacent the upper end comprising:
(a) securing the lower end of a vertically positioned tower first section to a foundation;
(b) releasably securing the outer load lifting end of a telescoping multiple section hydraulically extendable and retractable boom so that the boom load lifting end can pivot about a horizontal axis;
(c) the boom having a base section, at least one extendable section and a load lifting end;
(d) the boom base section having a see-saw beam mounted thereon to pivot about an axis longitudinal to the boom;
(e) raising the boom to vertical position;
(f) hydraulically extending the boom upwardly, with the boom load lifting end section stationary, so that the boom extends vertically upwardly a substantial distance above the top of the tower first section;
(g) releasably securing the boom to the tower first section near the top of the tower first section by a boom upper sliding support on the boom;
(h) raising a second tower section by means of the see-saw beam and lifting lines, placing it on top of the tower first section and joining the first and second tower sections together;
(i) attaching a temporary boom support to the upper part of the tower second section and releasably securing the boom base section to it and then releasing the boom from the tower where it was previously secured thereto;
(j) retracting the boom with vertically upward displacement of the boom load lifting end and releasably securing the boom load lifting end to the tower second section;
(k) securing the boom upper portion against excessive lateral movement and disconnecting the temporary boom support from the tower and the boom;
(l) hydraulically extending the boom upwardly, with the boom load lifting end section stationary, so that the boom extends vertically upwardly a substantial distance above the top of the tower second section;
(m) releasably securing the boom upper sliding support to the tower second section upper portion;
(n) repeating steps (f) to (m) when necessary to increase the height of the tower;
(o) by use of the see-saw beam raising a pedestal comprising an adapter and boom turret to the top of the tower, the adapter having an upper portion rotatably mounted on bearing means supported by a lower portion, and releasably securing the adapter lower portion to the tower top;
(p) the boom turret being pivotally joined to the top of the adapter to rotate about a horizontal axis;
(q) releasing the upper part of the boom from the tower and positioning the boom base end adjacent the boom turret, tilting the boom turret into close contact with the boom base end and joining the turret to the boom base end by a horizontal boom footpin;
(r) releasing the boom lifting end from the tower;
(s) connecting means to the boom for pivoting the boom vertically about the horizontal boom footpin;
(t) rotating the tilted turret into contact with the adapter upper portion top end and releasably securing the turret to the adapter; and
(u) fixedly securing the see-saw beam to the boom so it is stationary.

3. A method of installing a hydraulic boom on the top of a high vertical tower boom support comprising:
vertically positioning a first tower section and securing the tower section to a base;
installing a plurality of additional tower sections in consecutive order on top of the first tower section and securing the adjoining sections together until a tower is erected having a desired height;
a boom having a base section, at least one extendable section and a load lifting end;
releasably attaching the boom in vertical position to and along side the tower as it is erected with the boom load lifting end at the bottom;
jumping the boom vertically upwardly by alternately extending and retracting various boom sections as the tower sections are installed;
positioning the boom base end adjacent the boom turret, tilting the boom turret into close contact with the boom base end and joining the turret to the boom base end by a horizontal boom footpin;
releasing the boom from the tower;
tilting the turret into contact with the adapter upper portion top end and releasably securing the turret to the adapter; and
connecting means to the boom for pivoting the boom vertically about the horizontal boom footpin.

4. A method according to claim 3 in which the boom is a telescoping multiple section hydraulically extendable and retractable boom having at least three sections.

5. A method according to claim 3 in which the connecting means for pivoting the boom vertically about the horizontal boom footpin is a hydraulic cylinder means.

6. A method of erecting a pedestal crane having a vertical tower with a boom adjacent the upper end comprising:
(a) securing the lower end of a vertically positioned tower first section to a foundation;
(b) releasably securing the outer load lifting end of a telescoping multiple section hydraulically extendable and retractable boom to the tower first section by a lower boom support so that the boom outer load lifting end can pivot about a horizontal axis;
(c) the boom having a base section, at least one boom extending section and an end section having the load lifting end;
(d) the boom base section having a see-saw beam mounted thereon to pivot about an axis longitudinal to the boom;
(e) raising the boom in a fully retracted condition to vertical position;
(f) hydraulically extending the boom upwardly, with the boom end section stationary, so that the boom extends vertically upwardly a substantial distance above the top of the tower first section;
(g) releasably securing the boom to the tower first section by an upper sliding support on the boom;
(h) raising a second tower section by means of the see-saw beam and lifting lines thereon, placing it on top of the tower first section and joining the first and second tower sections together;

(i) attaching a temporary boom support to the upper part of the tower second section and releasably securing the boom base section to it and then releasing the lower boom support and the boom upper sliding support from the tower to thereby release the boom from the tower where it was previously secured thereto by them;

(j) retracting the boom with vertically upward displacement of the boom load lifting end and releasably securing the boom load lifting end to the tower second section by means of the lower boom support;

(k) securing the boom upper portion against excessive lateral movement and disconnecting the temporary boom support from the tower and the boom;

(l) hydraulically extending the boom upwardly, with the boom load lifting end section stationary, so that the boom extends vertically upwardly a substantial distance above the top of the tower second section;

(m) releasably securing the boom upper sliding support to the tower second section upper portion;

(n) repeating steps (f) to (m) when necessary to increase the height of the tower;

(o) by use of the see-saw beam raising a pedestal comprising an adapter and boom turret to the top of the tower, the adapter having an upper portion rotatably mounted on bearing means supported by a lower portion, and releasably securing the adapter lower portion to the tower top;

(p) the boom turret being pivotally joined to the top of the adapter to rotate about a horizontal axis;

(q) releasing the upper part of the boom from the tower by separating the boom upper sliding support from the tower, positioning the boom base end adjacent the boom turret, tilting the boom turret into close contact with the boom base end and joining the turret to the boom base end by a horizontal boom footpin;

(r) releasing the boom lifting end from the tower;

(s) connecting boom lifting hydraulic means to the turret and the boom;

(t) rotating the tilted turret into contact with the adapter upper portion top end and releasably securing the turret to the adapter; and (u) fixedly securing the see-saw beam to the boom so it is stationary.

7. A pedestal crane having a vertical tower with a boom adjacent the upper end comprising:

(a) a vertically positioned tower first section having a lower end secured to a foundation;

(b) the boom base section having a see-saw beam mounted thereon to pivot about an axis longitudinal to the boom;

(c) means to releasably secure the load lifting end of a telescoping multiple section hydraulically extendable and retractable boom, the boom having a base section and at least one extendable section, to a lower portion of the tower first section so that the boom load lifting end can pivot about a horizontal axis;

(d) means to releasably secure the boom vertically to the tower first section near the top of the tower first section;

(e) means to hydraulically extend the boom upwardly, with the boom load lifting end section stationary, so that the boom extends vertically upwardly a substantial distance above the top of the tower first section;

(f) means to raise a second tower section by means of the see-saw beam and lifting lines to place it on top of the tower first section and join the first and second tower sections together;

(g) means to attach a temporary boom support to the upper part of the tower second section and releasably secure the boom base section to it so that the load lifting end can be released from the tower lower portion;

(h) means to retract the boom with vertically upward displacement of the boom load lifting end and means releasably securing the boom load lifting end to the tower;

(i) means to secure the boom upper portion against excessive lateral movement when the temporary boom support is disconnected from the boom and the tower;

(j) means to hydraulically extend the boom upwardly, with the boom load lifting end section stationary, so that the boom can extend vertically upwardly above the top of the tower second section;

(k) means to releasably secure the boom upper sliding support to the tower second section upper portion;

(l) means including the see-saw beam to raise a pedestal comprising an adapter and boom turret to the top of the tower, the adapter having an upper portion rotatably mounted on bearing means supported by a lower portion and means for releasably securing the adapter lower portion to the tower top;

(m) the boom turret being pivotally joined to the top of the adapter to rotate about a horizontal axis;

(n) means to release the upper part of the boom from the tower and position the boom base end adjacent the boom turret, means for tilting the boom turret into close contact with the boom base end and means joining the turret to the boom base end by a horizontal boom footpin;

(o) means for rotating the tilted turret into contact with the adapter upper portion top end and means releasably securing the turret to the adapter; and (p) means for pivoting the boom vertically about the horizontal boom footpin.

8. A pedestal crane comprising:

a high vertical tower with a top;

an adapter having a hollow upper portion with a top and being rotatably mounted on bearing means supported by an adapter lower portion with means releasably securing the adapter lower portion to the tower top;

a boom turret pivotally joined to the top of the adapter upper portion to rotate about a horizontal axis;

a boom having a base section, at least one extendable section and a load lifting end;

means joining the boom base end to the turret by a horizontal boom footpin;

means within the adapter hollow upper portion for tilting the turret into contact with the adapter upper portion top and means releasably securing the turret to the adapter; and means for pivoting the boom vertically about the horizontal boom footpin.

9. A pedestal crane according to claim 8 in which the means for pivoting the boom vertically about the horizontal boom footpin comprises a hydraulic cylinder means.

10. A pedestal crane according to claim 8 in which the boom is a telescoping extendable and retractable boom having at least three sections.

11. A pedestal crane according to claim 8 in which the means within the adapter hollow upper portion for tilting the turret into contact with the adapter upper portion top comprises a hydraulic cylinder means.

12. A pedestal crane according to claim 11 in which the hydraulic cylinder means is operatively connected to the turret and to the adapter hollow upper portion.

* * * * *